US011682533B2

(12) United States Patent
Powell

(10) Patent No.: US 11,682,533 B2
(45) Date of Patent: Jun. 20, 2023

(54) EARBUD WITH ROTARY SWITCH

(71) Applicant: Soniphi LLC, Incline Village, NV (US)

(72) Inventor: Wayne J. Powell, Centennial, CO (US)

(73) Assignee: Soniphi LLC, Incline Village, NV (US)

( * ) Notice: Subject to any disclaimer, the term of this patent is extended or adjusted under 35 U.S.C. 154(b) by 0 days.

(21) Appl. No.: 17/515,287

(22) Filed: Oct. 29, 2021

(65) Prior Publication Data

US 2022/0051860 A1 Feb. 17, 2022

Related U.S. Application Data

(63) Continuation of application No. 16/553,472, filed on Aug. 28, 2019, now abandoned.

(60) Provisional application No. 62/724,536, filed on Aug. 29, 2018.

(51) Int. Cl.

| | |
|---|---|
| ***H01H 19/14*** | (2006.01) |
| ***H01H 13/14*** | (2006.01) |
| ***H04R 1/10*** | (2006.01) |

(52) U.S. Cl.

CPC ..... *H01H 19/14* (2013.01); *H01H 13/14* (2013.01); *H04R 1/1016* (2013.01)

(58) Field of Classification Search

CPC ..... H01H 19/14; H01H 13/14; H01H 25/06; H04R 1/1016; H04R 1/1041

See application file for complete search history.

(56) References Cited

U.S. PATENT DOCUMENTS

| | | | | |
|---|---|---|---|---|
| 4,783,816 | A * | 11/1988 | Buttner | H04R 25/65 381/322 |
| D627,338 | S | 11/2010 | Koss et al. | |
| 8,340,338 | B2 | 12/2012 | Mlodzikowski et al. | |
| 10,687,136 | B2 | 6/2020 | Jenkins et al. | |
| 10,757,491 | B1 * | 8/2020 | Jackson | G06F 3/0362 |
| 2008/0058037 | A1 * | 3/2008 | Dunn | H04R 1/1041 455/575.2 |
| 2009/0129618 | A1 * | 5/2009 | Heerlein | H01H 25/06 381/328 |
| 2010/0292990 | A1 * | 11/2010 | Lee | G06F 3/0482 704/E15.04 |
| 2014/1400565 | | 5/2014 | Liu | |
| 2015/0257662 | A1 | 9/2015 | Lee et al. | |

(Continued)

FOREIGN PATENT DOCUMENTS

| | | |
|---|---|---|
| CN | 206294320 U | 6/2017 |
| KR | 102017003 B1 | 10/2019 |

OTHER PUBLICATIONS

International Search Report and Written Opinion for PCT/US2019/048744 dated Mar. 31, 2020, 19 pgs.

*Primary Examiner* — Angelica M Mckinney
(74) *Attorney, Agent, or Firm* — Fish IP Law, LLP

(57) ABSTRACT

An earbud device having a user interface that incorporates a rotary switch is described. The rotary switch is part of a stem that extends from the main body of the earbud, and can provide file selection and/or volume control functions. The interface can include a pressure switch, which can provide switching between on, off, and sleep modes. The pressure switch can also be positioned on the stem, and in some embodiments the rotary switch can also act as the pressure switch when pressed. In some embodiments the user interface can utilize a combination of rotary switch and pressure switch inputs.

14 Claims, 1 Drawing Sheet

(56) References Cited

U.S. PATENT DOCUMENTS

| | | | |
|---|---|---|---|
| 2015/0264472 | A1 | 9/2015 | Aase |
| 2017/0094389 | A1 | 3/2017 | Saulsbury et al. |
| 2017/0238080 | A1 | 8/2017 | McCarthy |
| 2017/0311068 | A1 | 10/2017 | Shin |
| 2018/0146310 | A1 | 5/2018 | Bazzoni |
| 2020/0100013 | A1 | 3/2020 | Harjee et al. |

* cited by examiner

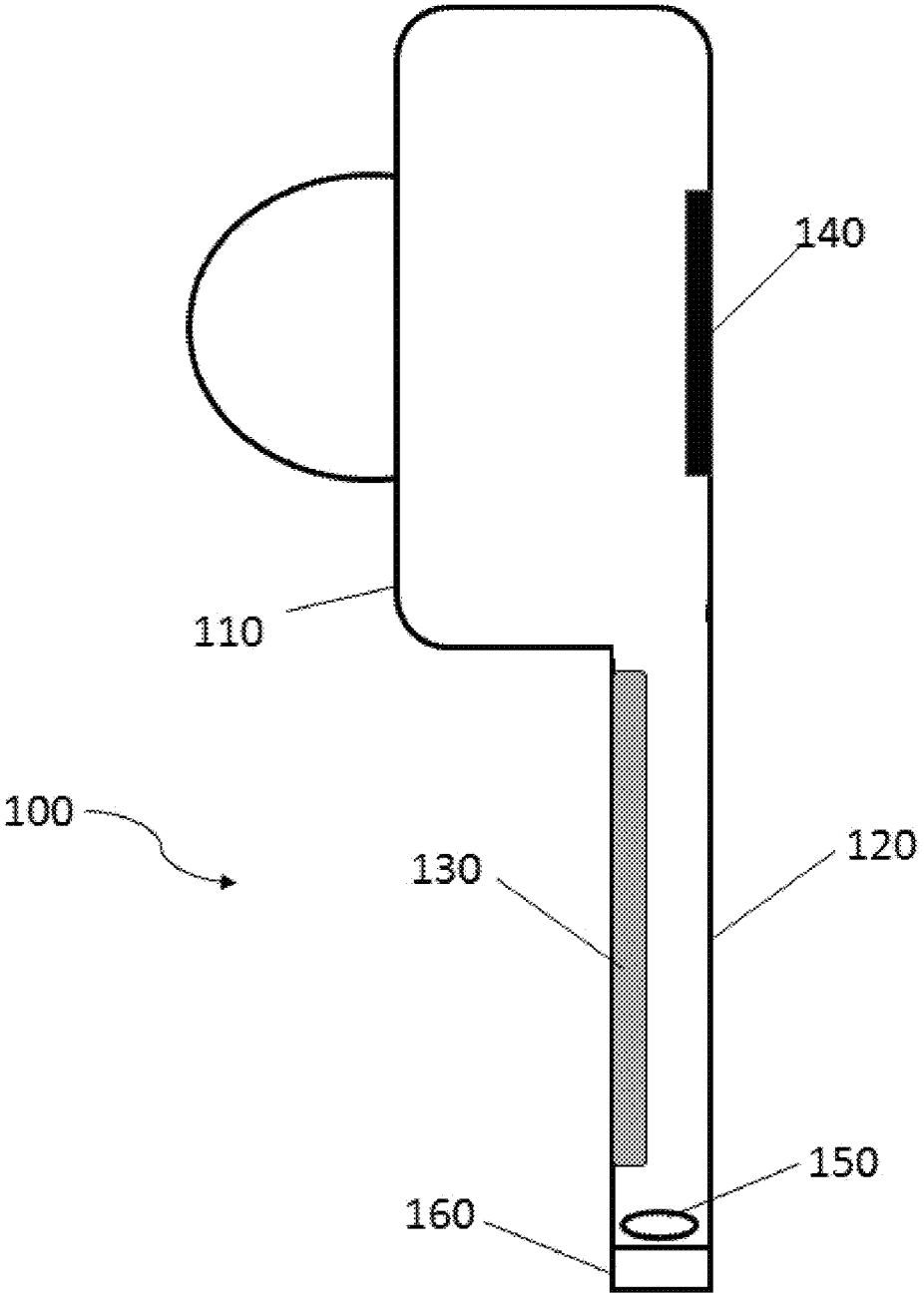
140
110
100
130
120
150
160

EARBUD WITH ROTARY SWITCH

This application is a continuation of pending U.S. patent application Ser. No. 16/553,472, filed on Aug. 28, 2019, which claims the benefit of U.S. Provisional Patent Application No. 62/724,536, filed on Aug. 29, 2018. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is control systems for earbuds.

BACKGROUND

The following description includes information that may be useful in understanding the present invention. It is not an admission that any of the information provided herein is prior art or relevant to the presently claimed invention, or that any publication specifically or implicitly referenced is prior art.

Conventional portable audio systems often include a pair of headphones that are connected to a portable media player (e.g., with one or more wires). As the headphone industry has expanded, the style range of headphones from which a user may choose has increased. One popular style or configuration of headphones is known as "earbud-style" headphones (e.g., headphones designed to fit within a user's ear). Earbud-style headphones are popular among users because earbud headphones are generally small and portable. Moreover, when a user is participating in various activities, earbud headphones may cooperate better with the user's other accessories or equipment, such as helmets, ski goggles, ear protectors, beanies, and headbands.

With the increasing popularity of earbuds and the increase in advanced media playback functions available to current devices, the corresponding problem of allowing a user to effectively control media playback using a small user interface has emerged. The use of conventional buttons in small playback devices requires a high degree of targeted button presses in particular patterns. Alternatively, some earbud devices use patterns in data obtained from accelerometers imbedded in the earbud to allow a user to perform rudimentary tasks by tapping. Such accelerometers, however, are also affected by other movements, such as impact on walking, turning of the head, etc., and require sophisticated data filtering to avoid false inputs. As such, conventional media playback control mechanisms are difficult to use with precision and simplicity.

U.S. Pat. No. 8,340,338 (to Mlodzikowski et al.) describes an earbud device that includes a relatively large rotatable feature on the device's main body, which projects outward from the ear when worn. Rotation of this feature applies mechanical pressure to an internal mechanism that expands the portion of the earbud that is inserted into the ear canal, which in turn provides a secure fit. All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Therefore, further improvements of earbud control systems are desired. Thus, there is still a need in the art for improved physical user interfaces for earbuds.

SUMMARY OF THE INVENTION

Embodiments of the inventive concept provide a control interface for an earbud (such as an earbud that forms all or part of a personal entertainment system), where the earbud includes a rotary switch that acts as a user interface for a processor or controller that controls functions of the earbud. In preferred embodiments the earbud also includes a pressure switch that provides additional or complementary control functions.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

One embodiment of the inventive concept is a control interface for an earbud, that includes an earbud having a stem and a processor; a rotary switch coupled to the stem and electronically coupled to the processor, and a pressure switch that is electronically coupled to the processor. The processor is configured to execute one or more program instructions in response to electrical signals from the rotary switch and/or the pressure switch. In some embodiments the pressure switch is positioned on or in stem. For example, the stem can include a pressure sensitive portion that acts as the pressure switch, or the rotary contact switch can include or act as the pressure switch. Program instructions include one or more of a power on instruction, a power off instruction, a sleep instruction, a volume modulation instruction, a fast forward instruction, a rewind instruction, a skip forward instruction, and a skip backward instruction. In some embodiments input from the pressure switch activates a power on instruction, a power off instruction, and/or a sleep instruction. In some embodiments a signal received by the processor from the rotary switch activates a volume modulation instruction, a fast forward instruction, a rewind instruction, a skip forward instruction, and a skip backward instruction.

Another embodiment of the inventive concept is an earbud that includes a housing having a stem and enclosing a processor, a pressure switch electronically coupled to the processor, and a rotary switch coupled to the stem and electronically coupled to the processor. The processor incorporates one or more program instructions that are executable to control functions of the earbud. The pressure switch can be positioned on or in the stem. For example, the stem can have a pressure sensitive portion that acts as the pressure switch, or the rotary contact switch can incorporate or act as the pressure switch. Program instructions of the processor can include a power on instruction, a power off instruction, a sleep instruction, a volume modulation instruction, a fast forward instruction, a rewind instruction, a skip forward instruction, and/or a skip backward instruction. In some embodiments a signal received by the processor from the pressure switch activates a power on instruction, a power off instruction, and/or a sleep instruction. In some embodiments a signal received by the processor from the rotary switch activates a volume modulation instruction, a fast forward instruction, a rewind instruction, a skip forward instruction, and/or a skip backward instruction.

Various objects, features, aspects and advantages of the inventive subject matter will become more apparent from the following detailed description of preferred embodiments, along with the accompanying drawing FIGURES in which like numerals represent like components.

BRIEF DESCRIPTION OF THE DRAWINGS

FIG. 1 provides a schematic depiction of an earbud of the inventive concept.

DETAILED DESCRIPTION

The inventive subject matter provides apparatus, systems, and methods in which an earbud shaft comprises a rotary switching contact to provide a control mechanism.

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

An earbud of the inventive concept can include a housing or body that is in contact with and/or at least partially inserted into an ear of a user when in use. Such a housing can be constructed of one or more materials suitable for contact with human skin, and can have different compositions in different regions of the housing. For example, portions of the housing that are exposed when in use can be constructed of one or more rigid materials (e.g. hard plastic, metal, ceramic, etc.) whereas portions that are inserted into the ear canal can be constructed of one or more pliant materials (e.g. silicone rubber, latex, polyurethane, etc.). In some embodiments an earbud of the inventive concept can include a hook or similar projection that engages with the concha of the ear, improving stability and proper positioning of the earbud. The housing of the earbud can also support one or more control features that can be used to control earbud functions. In a preferred embodiment a portion of the body or housing can extend downwards in a stem or stalk.

Such an earbud can include a power supply (such as a battery) and one or more speakers, and is in communication with a source of audio and/or video files for playback through the earbud. Such audio and/or video files can be stored on memory within the earbud, or can be stored on memory in an external device (such as a computer, telephone, or portable audio player). In embodiments where audio and/or video files are stored in an external device the earbud can include an antenna, circuitry, and appropriate processing to support wireless communication (e.g. BluetTooth, WiFi, etc.). Alternatively or in addition to such wireless circuitry, and earbud of the inventive concept can include a port that supports a wired connection. Earbuds of the inventive concept can also include an antenna and associated circuitry to support wireless charging of an onboard power supply, for example by magnetic induction.

In embodiments of the inventive concept rotary switch is positioned on a stem or stalks that extends from an earbud. This rotary switch allows a user to provide instructions to a processor and/or microcontroller, and so serves as at least a portion of an input-output (I/O) interface. The rotary switch can be an analog switch or a digital switch. In preferred embodiments, activating the I/O interface is accomplished by rotating a spring loaded disc positioned at the bottom or terminal portion of the shaft. While rotating momentary contact is made with contact surfaces, which in turn results in signals being sent to the processor or microcontroller.

In some embodiments the earbud can also include a pressure sensitive switch. In a preferred embodiment the rotary switch can incorporate or form a portion of a push up contact switch located in the same assembly. Such a pressure sensitive switch can be used to activate an additional contact in order to provide additional signals to the processor or microcontroller. For example, application of pressure to such a pressure sensitive switch can act to turn the earbud on and/or off via the processor or microcontroller.

In preferred embodiments, the earbud has a housing or main body portion with an extended curvature configuration. In one example, the earbud includes a speaker housing that is separated into a divided group of isobaric sound chambers and an extension that couples the isobaric sound chambers via a transmission line to form a waveguide between the speaker housing and the extension.

An embodiment of an earbud of the inventive concept is shown in FIG. 1. As shown, such an earbud (100) can have a housing (110) from which a stem or stalk (120) extends. The stem or stalk can enclose a power source (130), such as a battery, that provides electrical power to a processor or microcontroller (140) as well as other components of the earbud. In some embodiments the processor or microcontroller is positioned within a portion of the housing (110) that is in contact with the concha of the ear of a user when the earbud is in place.

Such an earbud (100) can also include control mechanisms in the form of rotary and pressure switches positioned at the terminus of the stem or stalk (120). As shown in FIG. 1, the stem or stalk can include a rotary switch (160), where the rotary switch can be easily accessed and manipulated. In some embodiments the rotary switch (160) is a discrete device positioned at the terminus of the stem or stalk. In other embodiments all or part of the stem or stalk can be rotated to activate the rotary switch.

The stem or stalk (120) can also include a pressure sensitive switch (150), which can be triggered by application of pressure. Such a pressure sensitive switch can be oriented to be activated by pressure applied to the terminus of the stem or stalk (120) and directed along the long axis of the stalk or stem and towards the housing (110). In such an embodiment the rotary switch (160) can be mounted on a pliant or spring-loaded coupling that permits movement towards the rotary switch (150). In such an embodiment the rotary switch (150) can be activated by applying pressure to the rotary switch (160) in a direction perpendicular to the plane of its rotation. In other embodiments the pressure sensitive switch (150) can be positioned and oriented to be activated by pressure applied at right angles to the long axis of the stem or stalk, for example by using a pinching grip on the stem or stalk. In such embodiments the stem or stalk can be constructed of or include a pliant material that permits sufficient compression to activate the pressure sensitive switch.

Both the pressure sensitive switch (150) and the rotary switch (160) are in communication with the processor or microcontroller (140), and can be used to control functions of the earbud. In a preferred embodiments the pressure sensitive switch (150) can be used to switch the earbud between on and off modes, between on and sleep modes, and/or between on, sleep, and off modes. Towards that end the microprocessor can include an algorithm that permits pattern recognition of signals received from the pressure sensitive switch. For example, a single activation can indicate switching between on and sleep modes, whereas two activations in rapid succession can indicate switching between on and off modes. Other functions, such as file selection, initiation of voice commands received through a microphone, pairing and unpairing of wireless connections, etc. can be similarly encoded by rhythms applied to the pressure sensitive switch.

In some embodiments the rotary switch (160) can be used to adjust volume of sound output from the earbud, fast forward playback through the earbud, rewind playback through the earbud, skip forward to play a different stored file, and skip backward to play a different stored file. In some embodiments instructions from the user can be conveyed to the processor and/or microcontroller using a combination of inputs from the pressure sensitive switch and the rotary switch. In embodiments application of pressure to activate the pressure switch while turning the rotary switch can access different functions than rotation of the rotary switch in the absence of activation of the pressure switch. For example, rotation of the rotary switch without activation of the pressure switch can provide volume control, while rotation of the rotary switch with activation of the pressure switch can provide file navigation (e.g. file skipping, fast forward, reverse playback, etc.). This can be implemented conveniently in embodiments where the rotary switch incorporates or forms part of the pressure switch.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A control interface for an earbud, comprising:

an earbud comprising a stem and a processor;

a rotary switch coupled to the stem and electronically coupled to the processor;

a pressure switch that is electronically coupled to the processor;

wherein the processor is configured to execute a first program instruction in response to (i) an electrical signal from the rotary switch and (ii) no electrical signal from the pressure switch;

wherein the processor is configured to execute a second program instruction in response to simultaneous electrical signals from the rotary switch and the pressure switch; and wherein the first program instruction and the second program instruction are different.

2. The control interface of claim 1, wherein the pressure switch is positioned on or in stem.

3. The control interface of claim 1, wherein the stem comprises a pressure sensitive portion that acts as the pressure switch.

4. The control interface of claim 1, wherein the rotary switch comprises the pressure switch.

5. The control interface of claim 1, wherein the first program instructions is selected from the group consisting of a power on instruction, a power off instruction, a sleep instruction, a volume modulation instruction, a fast forward instruction, a rewind instruction, a skip forward instruction, and a skip backward instruction.

6. The control interface of claim 1, wherein the processor is configured to activate a program instruction selected from the group consisting of a power on instruction, a power off instruction, and a sleep instruction in response to (i) an electrical signal from the pressure switch and (ii) no electrical signal from the rotary switch.

7. The control interface of claim 1, wherein the second program instruction is selected from the group consisting of a power on instruction, a power off instruction, a sleep instruction, a volume modulation instruction, a fast forward instruction, a rewind instruction, a skip forward instruction, and a skip backward instruction.

8. An earbud comprising:

a housing comprising a stem and enclosing a processor;

a pressure switch electronically coupled to the processor;

a rotary switch coupled to the stem and electronically coupled to the processor, wherein the processor is configured to activate (i) a first program instruction when signals are received simultaneously by the pressure switch and the rotary switch, (ii) a second program instruction when a signal is received by only the rotary switch, and (iii) a third program instruction when a signal is received by only the pressure switch; and wherein the first program instruction and the second program instruction are different.

9. The earbud of claim 8, wherein the pressure switch is positioned on or in stem.

10. The earbud of claim 8, wherein the stem comprises a pressure sensitive portion that acts as the pressure switch.

11. The earbud of claim 8, wherein the rotary switch comprises the pressure switch.

12. The earbud of claim 8, wherein the first program instruction is selected from the group consisting of a power on instruction, a power off instruction, a sleep instruction, a volume modulation instruction, a fast forward instruction, a rewind instruction, a skip forward instruction, and a skip backward instruction.

13. The earbud of claim 8, wherein the third program instruction is selected from the group consisting of a power on instruction, a power off instruction, and a sleep instruction.

14. The earbud of claim 8, wherein the second program instruction is selected from the group consisting of, a volume modulation instruction, a fast forward instruction, a rewind instruction, a skip forward instruction, and a skip backward instruction.

* * * * *